US012655571B2

(12) United States Patent
Leibman et al.

(10) Patent No.: US 12,655,571 B2
(45) Date of Patent: Jun. 16, 2026

(54) DRYER APPLIANCE AND METHOD AND SYSTEM FOR STEAM GENERATION

(71) Applicant: Haier US Appliance Solutions, Inc., Wilmington, DE (US)

(72) Inventors: Alexander Leibman, Prospect, KY (US); Venkata Chakradhar Rangu, Louisville, KY (US); Ionelia Silvia Prajescu, Delray Beach, FL (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 544 days.

(21) Appl. No.: 18/324,671

(22) Filed: May 26, 2023

(65) Prior Publication Data

US 2024/0392491 A1 Nov. 28, 2024

(51) Int. Cl.

| | |
|---|---|
| ***D06F 58/02*** | (2006.01) |
| ***D06F 39/40*** | (2024.01) |
| ***D06F 58/04*** | (2006.01) |
| ***D06F 58/20*** | (2006.01) |
| ***D06F 58/26*** | (2006.01) |

(52) U.S. Cl.
CPC ..... *D06F 58/203* (2013.01); *D06F 58/206* (2013.01); *D06F 58/26* (2013.01)

(58) Field of Classification Search
CPC ..... D06F 58/02; D06F 58/26; D06F 58/20; D06F 58/04; D06F 39/40
USPC ..... 34/595, 132, 134
See application file for complete search history.

(56) References Cited

U.S. PATENT DOCUMENTS

| | | | | |
|---|---|---|---|---|
| 6,481,248 | B2 | 11/2002 | Willis | |
| 6,609,310 | B2 * | 8/2003 | Carnovale | D06F 43/086 34/454 |
| 6,889,399 | B2 | 5/2005 | Steiner et al. | |
| 7,520,145 | B2 | 4/2009 | Hong et al. | |
| 7,735,345 | B2 | 6/2010 | Wright et al. | |
| 7,997,006 | B2 | 8/2011 | Son et al. | |
| 8,176,656 | B2 | 5/2012 | Bae et al. | |

(Continued)

FOREIGN PATENT DOCUMENTS

| | | |
|---|---|---|
| CN | 213142529 U | 5/2021 |
| CN | 215925346 U | 3/2022 |

(Continued)

OTHER PUBLICATIONS

English translation of KR 202000038447 by PE2E, Dec. 12, 2025.*
English Induction Heating for Variably Sized Ferrous and Non-Ferrous Materials through Load Modulation, Dec. 12, 2025.*

*Primary Examiner* — Deming Wan
(74) *Attorney, Agent, or Firm* — Dority & Manning, P.A.

(57) ABSTRACT

A dryer appliance and steam generation system is provided. The dryer appliance includes a drum rotatably mounted within a cabinet. The drum defines a chamber for receipt of articles for drying. The drum includes a plurality of openings allowing fluid communication into the chamber. An induction heating element is positioned on a non-ferrous substrate. The non-ferrous substrate is positioned between the induction heating element and a ferrous substrate. The ferrous substrate is positioned in an interior volume, and a nozzle is positioned in the interior volume to eject water onto the ferrous substrate. The induction heating element is positioned fluidly separate from the water ejected from the nozzle.

18 Claims, 7 Drawing Sheets

(56) References Cited

U.S. PATENT DOCUMENTS

| | | | | |
|---|---|---|---|---|
| 8,863,403 | B2 | 10/2014 | Lee et al. | |
| 8,914,989 | B2 | 12/2014 | Ghosh et al. | |
| 9,194,076 | B2 | 11/2015 | Son et al. | |
| 9,255,732 | B2 | 2/2016 | Shu et al. | |
| 10,626,543 | B2 | 4/2020 | Lim | |
| 11,261,560 | B2 | 3/2022 | Chudnovsky et al. | |
| 11,479,895 | B2 | 10/2022 | Hong et al. | |
| 2012/0005915 | A1* | 1/2012 | Song | D06F 58/203 34/132 |
| 2013/0199250 | A1* | 8/2013 | Doh | D06F 39/40 68/5 C |

FOREIGN PATENT DOCUMENTS

| | | | | | |
|---|---|---|---|---|---|
| DE | 102018213432 | B3 | | 1/2020 | |
| JP | 6671227 | A | | 10/2017 | |
| KR | 20200038447 | A | * | 4/2020 | H05B 1/0233 |

* cited by examiner

DRYER APPLIANCE AND METHOD AND SYSTEM FOR STEAM GENERATION

FIELD OF THE INVENTION

The present subject matter relates generally to dryer appliances, or more specifically, to apparatuses and methods for steam generation of dryer appliances.

BACKGROUND OF THE INVENTION

Dryer appliances generally include a cabinet with a drum rotatably mounted therein. During operation, a motor rotates the drum, e.g., to tumble articles located within a chamber defined by the drum. Dryer appliances also generally include a system for passing dry, heated air through the chamber in order to dry moisture-laden articles positioned therein.

Some dryer appliances may also include a system for providing steam to the chamber. However, known dryer appliances including systems for providing steam to the chamber may generally output water into a heated cavity, which may result in some portion of water being vaporized while another portion of water may remain un-vaporized, such as to undesirably wet the clothes and produce wet spots.

Known dryer appliances with steam systems may further require time to generate heat in volumes at which water is provided, requiring significant amounts of energy and time to heat the volume before steam can be generated.

Accordingly, a dryer appliance with a system for steam generation that addresses one or more of these problems would be advantageous and beneficial.

BRIEF DESCRIPTION OF THE INVENTION

Advantages of the invention will be set forth in part in the following description, or may be apparent from the description, or may be learned through practice of the invention.

An aspect of the present disclosure is directed to a dryer appliance and steam generation system. The dryer appliance includes a drum rotatably mounted within a cabinet. The drum defines a chamber for receipt of articles for drying. The drum includes a plurality of openings allowing fluid communication into the chamber. An induction heating element is positioned on a non-ferrous substrate. The non-ferrous substrate is positioned between the induction heating element and a ferrous substrate. The ferrous substrate is positioned in an interior volume, and a nozzle is positioned in the interior volume to eject water onto the ferrous substrate. The induction heating element is positioned fluidly separate from the water ejected from the nozzle.

Another aspect of the present disclosure is directed to a steam generating dryer appliance. The steam generating dryer appliance includes a drum rotatably mounted within a cabinet. The drum defines a chamber for receipt of articles for drying. The drum includes a plurality of openings allowing fluid communication into the chamber. An air handler is configured to urge air into a heater assembly and provide air through a duct. The duct is in fluid communication with the plurality of openings at the drum to allow air to flow into the chamber. A manifold is formed at the duct. The manifold includes an outlet face at which an outlet opening is formed. The outlet opening provides fluid communication from the heater assembly to the chamber. The manifold forms an interior volume at which a nozzle is positioned to eject liquid water. The manifold includes a ferrous substrate at an internal side of the manifold at which the nozzle is configured to eject liquid water onto. A non-ferrous substrate is positioned at an external side of the manifold. An induction heating element is positioned on the non-ferrous substrate. The non-ferrous substrate is positioned between the induction heating element and the ferrous substrate at the manifold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
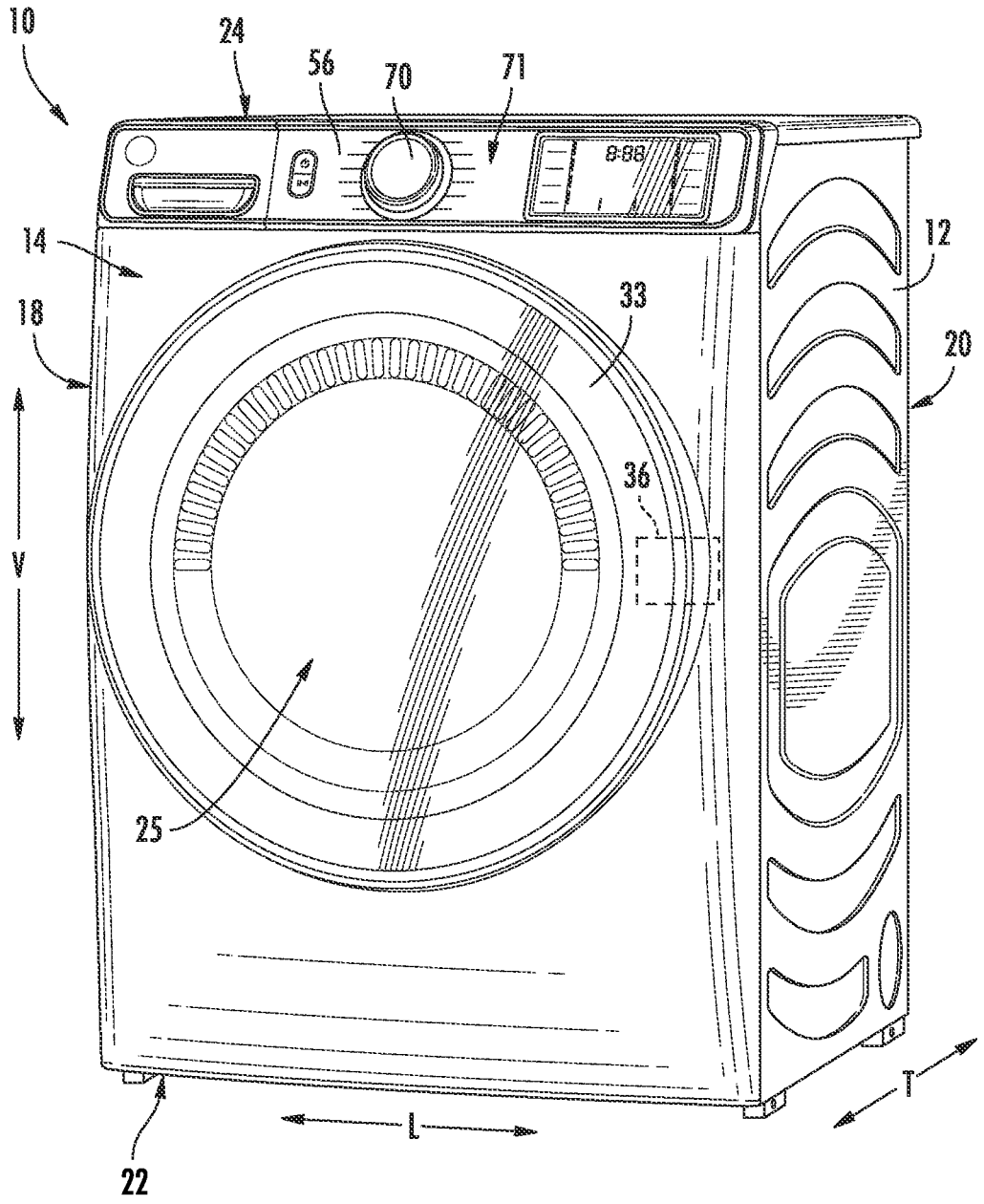
FIG. 1 provides a perspective view of a dryer appliance in accordance with exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
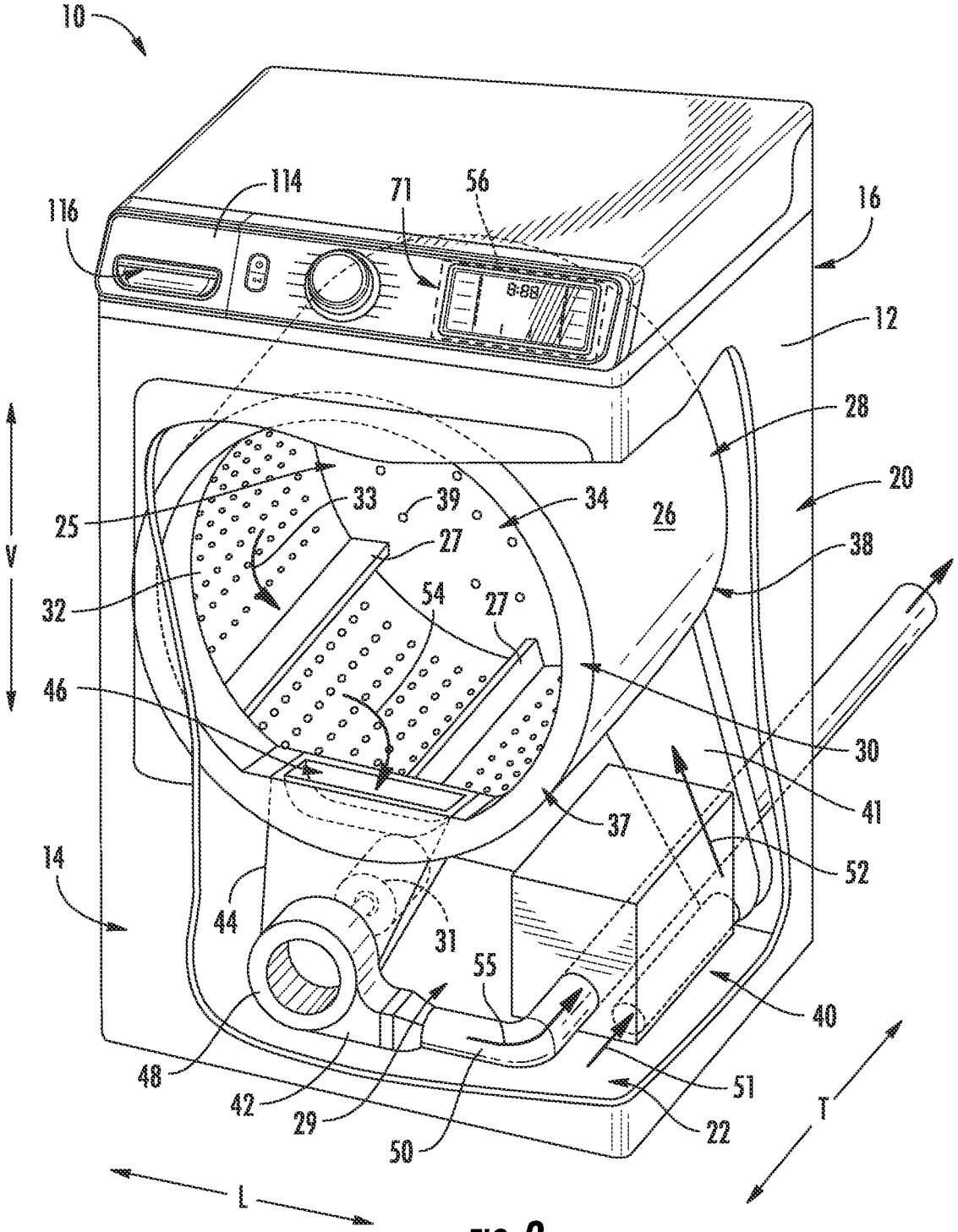
FIG. 2 provides a perspective view of the example dryer appliance of FIG. 1 with portions of a cabinet of the dryer appliance removed to reveal certain components of the dryer appliance.
Figure 3:
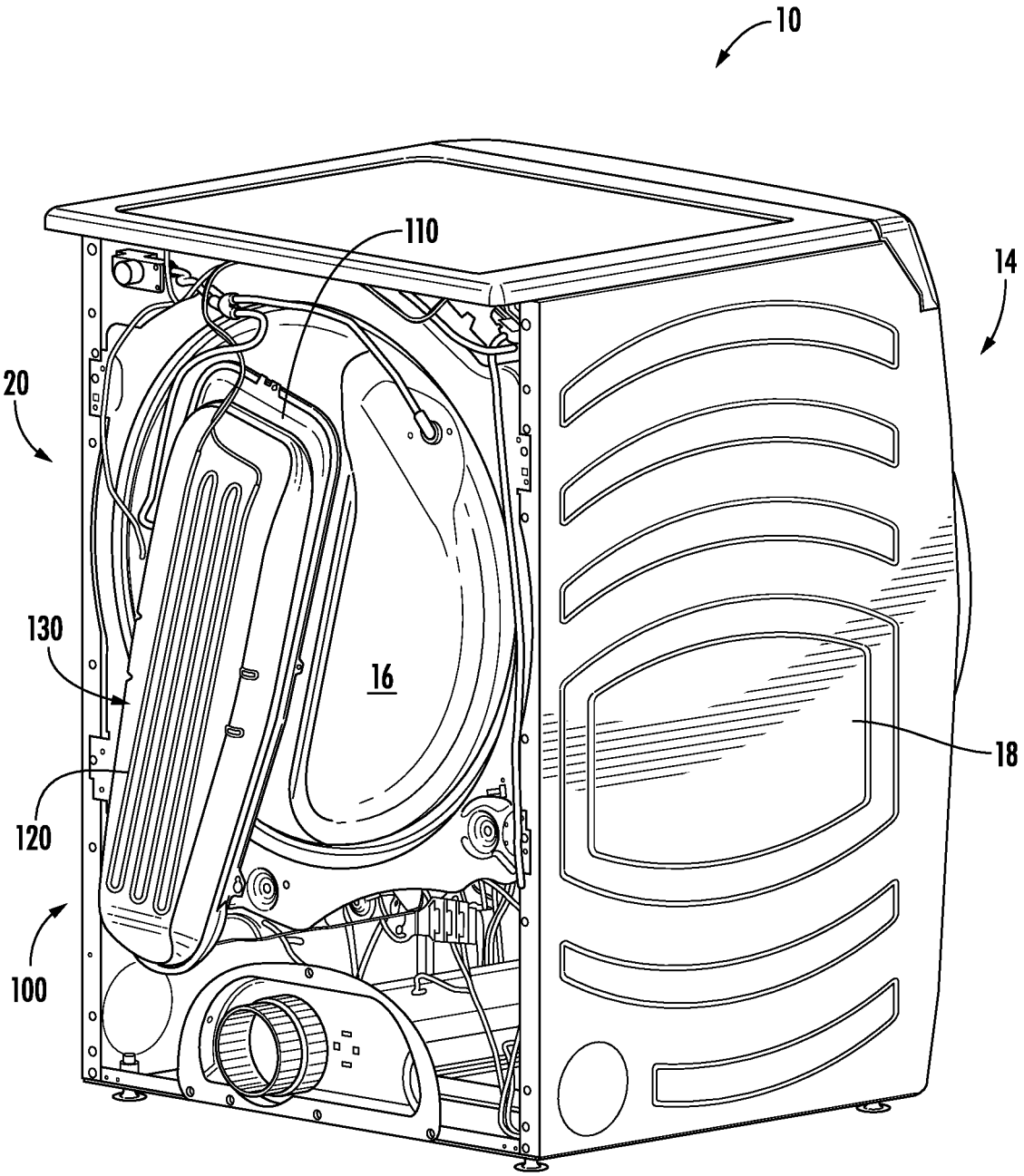
FIG. 3 provides a perspective view of the example dryer appliance of FIG. 1.
Figure 5:
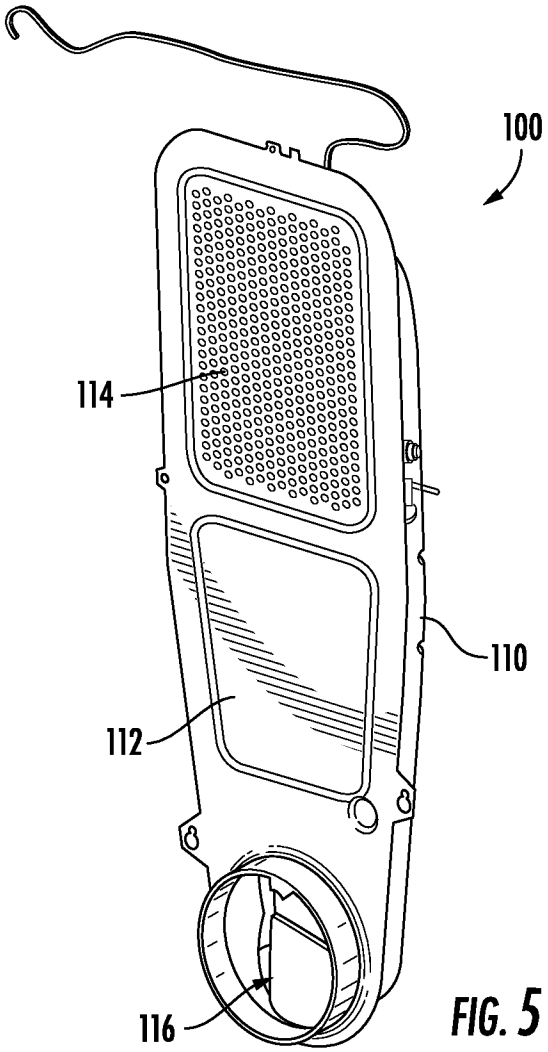
FIG. 5 provides a perspective view of the steam generator assembly for the dryer appliance in accordance with aspects of the present disclosure.
Figure 4:
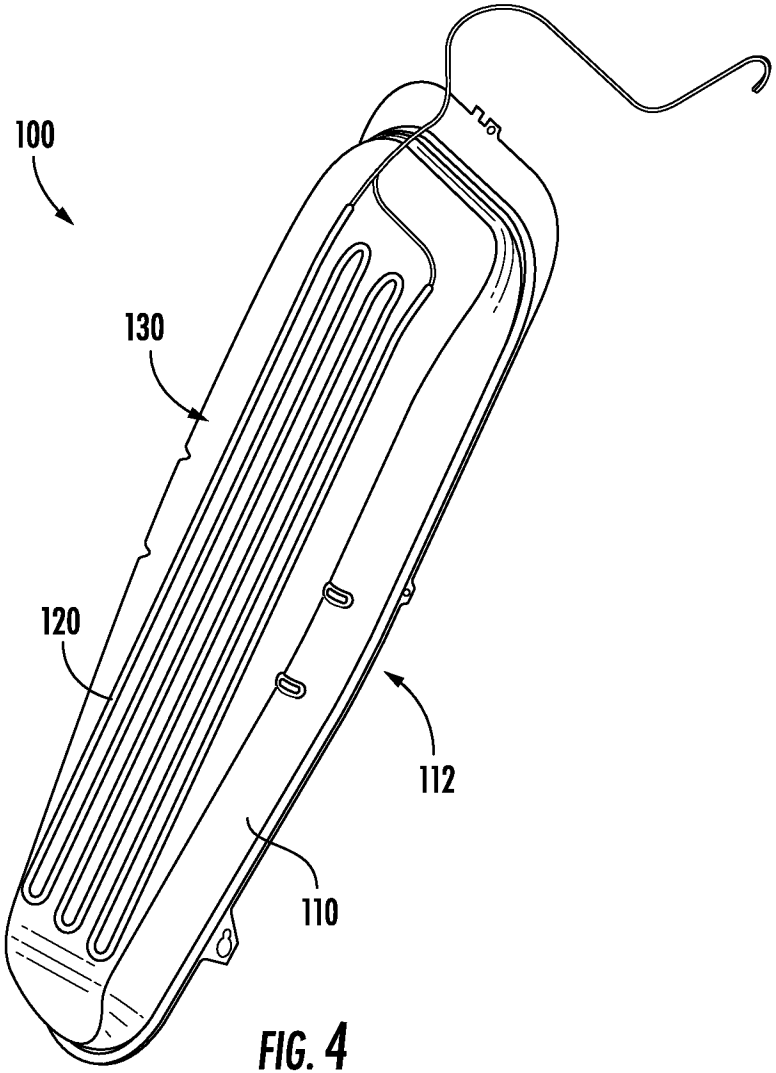
FIG. 4 provides a perspective view of a steam generator assembly for a dryer appliance in accordance with aspects of the present disclosure.
Figure 6:
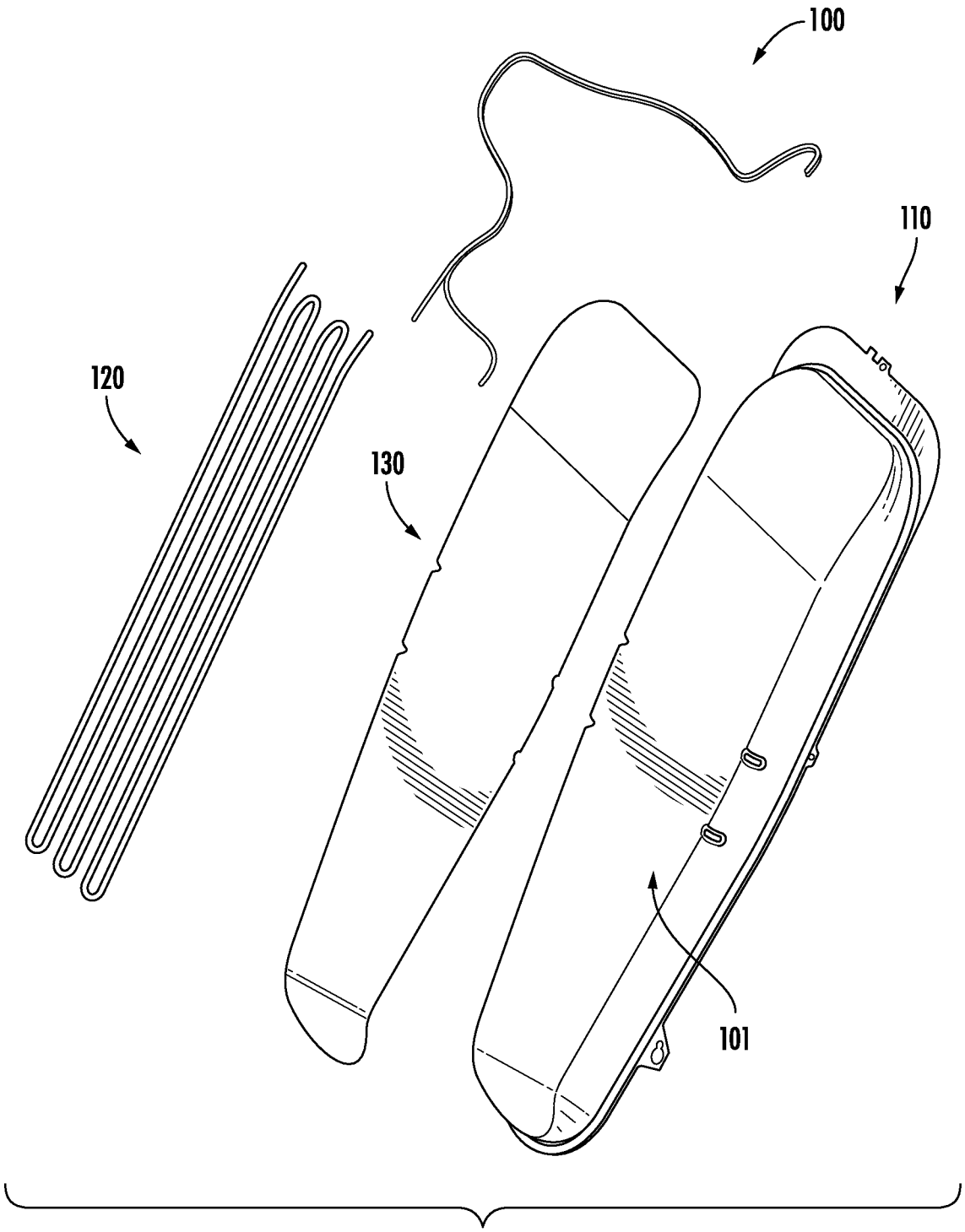
FIG. 6 provides an exploded perspective view of the steam generator assembly of FIG. 4 in accordance with aspects of the present disclosure.
Figure 7:
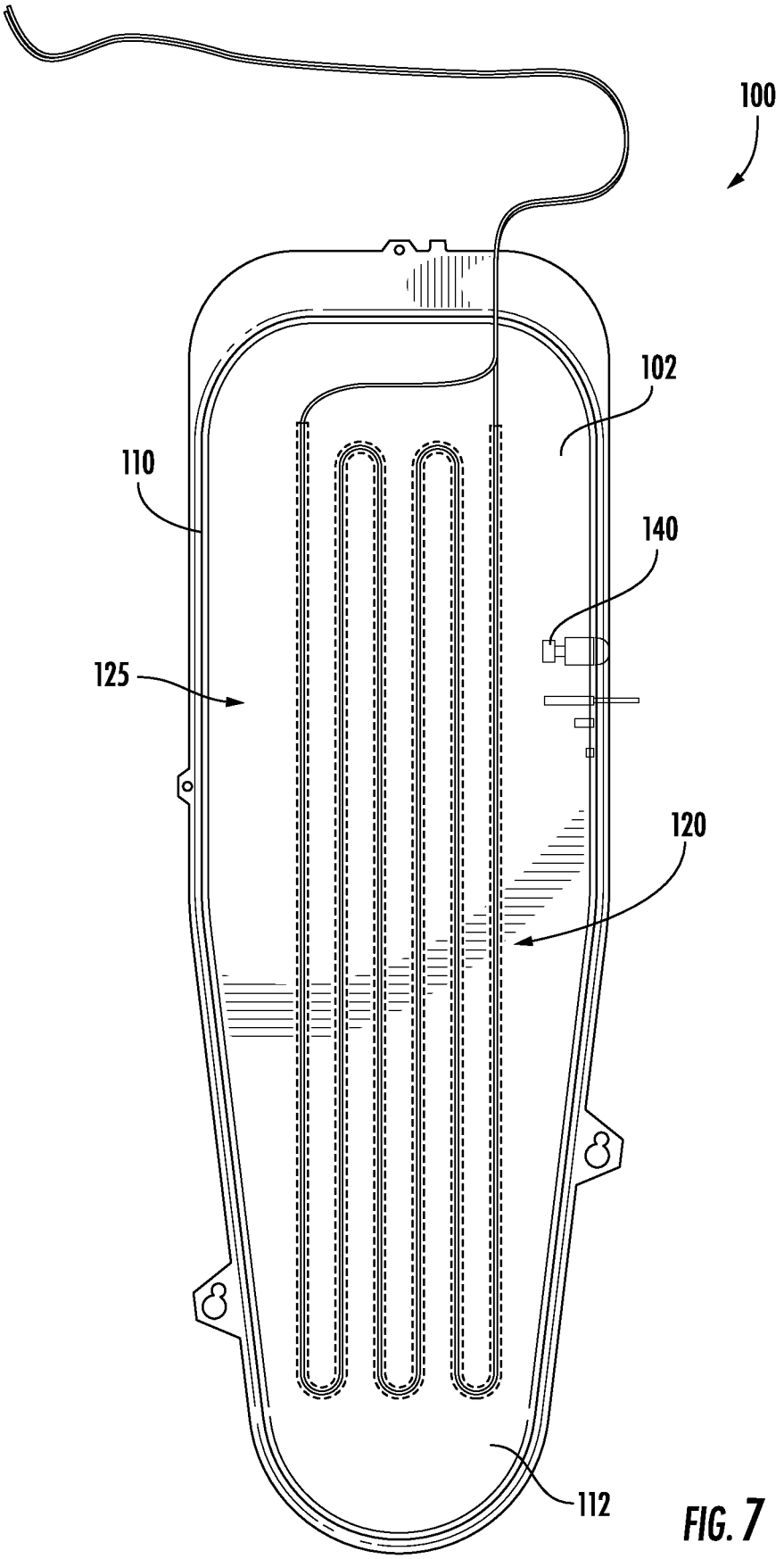
FIG. 7 provides a transparent view of an embodiment of the steam generator assembly in accordance with aspects of the present disclosure.
Figure 11:
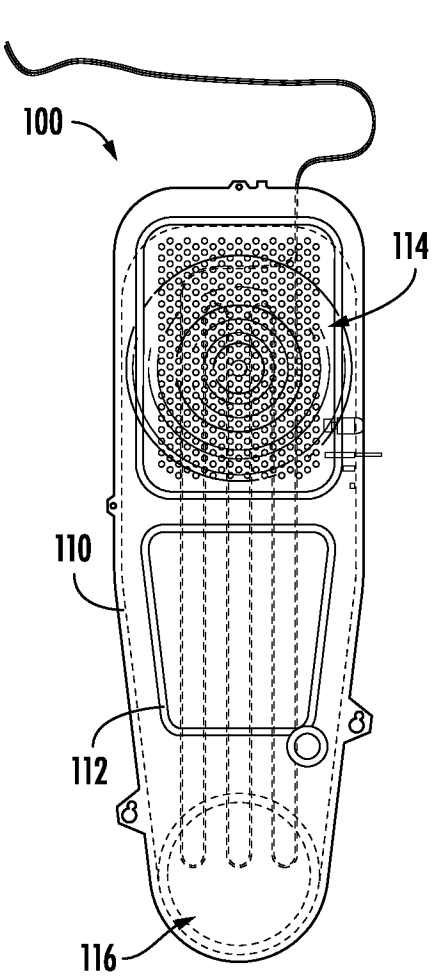
FIG. 11 provides a transparent view of an embodiment of the steam generator assembly in accordance with aspects of the present disclosure.
Figure 10:
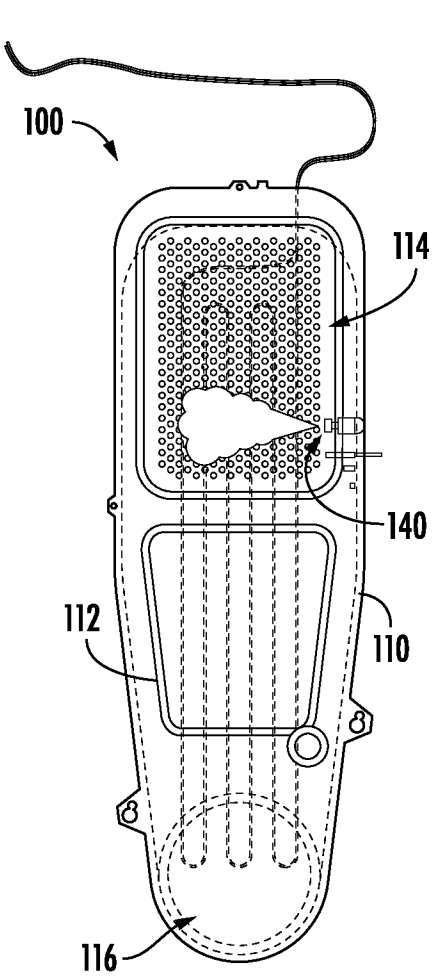
FIG. 10 provides a transparent view of an embodiment of the steam generator assembly in accordance with aspects of the present disclosure.
Figure 9:
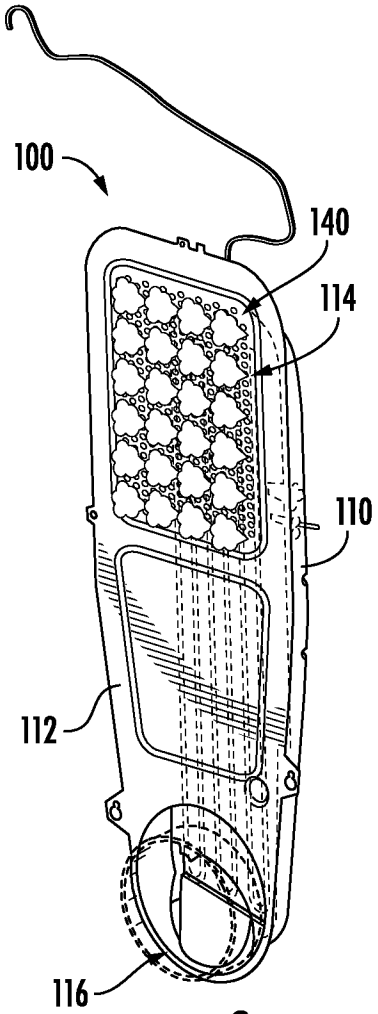
FIG. 9 provides a transparent view of an embodiment of the steam generator assembly in accordance with aspects of the present disclosure.
Figure 8:
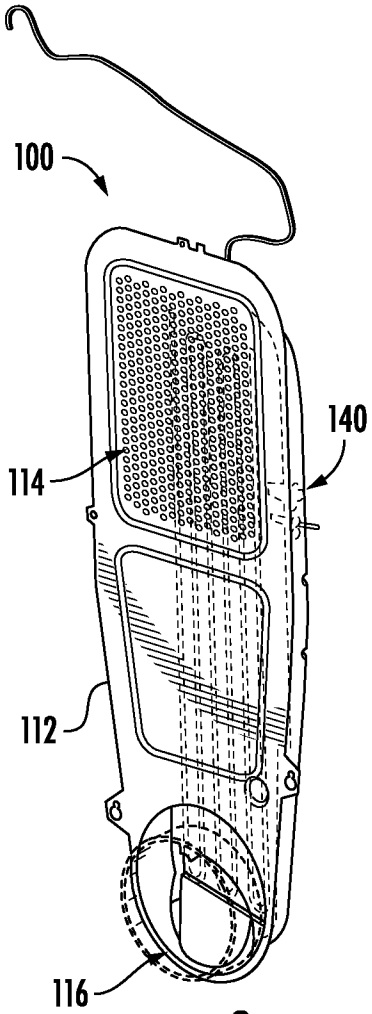
FIG. 8 provides a transparent view of an embodiment of the steam generator assembly in accordance with aspects of the present disclosure.

Referring now to the figures, an exemplary laundry appliance that may be used to implement aspects of the present subject matter will be described. Specifically, FIGS. 1 and 2 provide perspective views of a dryer appliance 10 according to exemplary embodiments of the present disclosure. Particularly, FIG. 1 provides a perspective view of dryer appliance 10. FIG. 2 provides another perspective view of dryer appliance 10 with a portion of a housing or cabinet 12 of dryer appliance 10 removed in order to show certain components of dryer appliance 10. FIG. 3 provides a perspective view of a portion of dryer appliance 10 with a portion of cabinet 12 of dryer appliance 10 removed to show certain internal components of dryer appliance 10. FIG. 4 provides a front view of an embodiment of dryer appliance 10. FIG. 5 provides a top-down view of an embodiment of dryer appliance 10 with a portion of cabinet 12 removed to show certain internal components of dryer appliance 10.

As depicted in FIG. 1, dryer appliance 10 defines a vertical direction V, a lateral direction L, and a transverse direction T, each of which is mutually perpendicular such that an orthogonal coordinate system is defined. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For instance, in some embodiments, dryer appliance 10 can be a combination washing machine/dryer appliance, a condenser dryer, or any other suitable laundry appliance.

Cabinet 12 includes a plurality of panels including a front panel 14, a rear panel 16, a pair of side panels 18 and 20 (e.g., a first side panel 18 and a second side panel 20) spaced apart from each other by front panel 14 and rear panel 16 along the lateral direction L, a bottom panel 22, and a top cover 24. Cabinet 12 defines an interior volume 29. A container or drum 26 is mounted for rotation about a substantially horizontal axis within the interior volume 29 of cabinet 12. Drum 26 defines a chamber 25 for receipt of articles for tumbling and/or drying. As used herein, the terms "clothing" or "articles" includes but need not be limited to fabrics, textiles, garments, linens, papers, or other items from which the extraction of moisture is desirable. Drum 26 extends between a front portion 37 and a back portion 38, e.g., along the transverse direction T. Drum 26 also includes a back or rear wall 34, e.g., at back portion 38 of drum 26. For example, dryer appliance 10 may be configured as an electric dryer appliance with electrical heating elements or as a gas dryer appliance with gas heating elements (e.g., gas burners) for heating air. heater assembly 40

In some embodiments, a motor 31 is provided to rotate drum 26 about the horizontal axis, e.g., via a pulley and a belt (not pictured). Drum 26 is generally cylindrical in shape. Drum 26 has an outer cylindrical wall 28 and a front flange or wall 30 that defines an opening 32 of drum 26, e.g., at front portion 37 of drum 26, for loading and unloading of articles into and out of chamber 25 of drum 26. Drum 26 includes a plurality of lifters or baffles 27 that extend into chamber 25 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Rear wall 34 of drum 26 is rotatably supported within cabinet 12 by a suitable bearing. Rear wall 34 can be fixed or can be rotatable. Rear wall 34 may include, for instance, a plurality of openings 39 that receive hot air that has been heated by a heater assembly 40. The heater assembly 40 may include a heat pump or refrigerant-based heater assembly. Moisture laden, heated air is drawn from drum 26 by an air handler 42 that draws air through chamber 25 of drum 26 when motor 31 rotates a fan assembly 48. In particular, ambient air, shown schematically via arrow 51, enters heater assembly 40 due to air handler 42 urging relatively cool ambient air 51 into the heater assembly 40. Such cool air 51 is selectively heated through the heater assembly 40 and is provided as heated air, shown schematically via arrow 52 to chamber 25. In various embodiments further described herein, heater assembly 40 may be non-activated or deactivated such that air 52, 53 provided to the chamber 25 is substantially similar to ambient air 51 (i.e., unheated). Air handler 42 draws heated air 52 through a duct 41, such as a back duct or first duct, to drum 26. Heated air 52 enters through the plurality of openings 39 and flows through chamber 25, such as depicted schematically via arrow 53. Within chamber 25, heated air 53 can accumulate moisture (e.g., from damp articles disposed within chamber 25). In turn, air handler 42 draws the moisture laden heated air, depicted schematically via arrow 54. Moisture laden heated air 54 enters through a duct 44. Duct 44 may form a front duct or second duct including a lint filter 46 (e.g., a screen filter) configured to collect lint during drying. The moisture laden heated air 54 passes through duct 44 enclosing filter 46, which traps lint particles. More specifically, filter 46 may include a screen, mesh, other material to capture lint in the air flow. The location of lint filters in appliance 10 as shown in FIG. 2 is provided by way of example only, and other locations may be used as well. As shown, lint filter 46 is readily accessible by a user of the appliance. Air then passes through air handler 42 to an exhaust duct 50, such as depicted schematically via arrows 55.

A door 33 provides for closing or accessing drum 26 through opening 32. According to exemplary embodiments, a window (not shown) in door 33 permits viewing of chamber 25 when door 33 is in the closed position, e.g., during operation of dryer appliance 10. Door 33 also includes a handle that, e.g., a user may pull when opening and closing door 33. Further, although door 33 is illustrated as mounted to front panel 14, it should be appreciated that door 33 may be mounted to another side of cabinet 12 or any other suitable support according to alternative embodiments. Dryer appliance 10 may further include a latch assembly 36 (see FIG. 1) that is mounted to cabinet 12 and/or door 33 for selectively locking door 33 in the closed position. Latch assembly 36 may be desirable, for example, to ensure only secured access to chamber 25 or to otherwise ensure and verify that door 33 is closed during certain operating cycles or events.

In some embodiments, one or more selector inputs 70, such as knobs, buttons, touchscreen interfaces, etc., may be provided or mounted on a cabinet 12 (e.g., on a user interface panel 71) and are communicatively coupled with (e.g., electrically coupled or coupled through a wireless network band) a processing device or controller 56. Controller 56 may also be communicatively coupled with various operational components of dryer appliance 10, such as motor 31, fan assembly 48, and/or components of heater assembly 40. In turn, signals generated in controller 56 direct operation of motor 31, fan assembly 48, or heater assembly 40 in response user inputs to selector inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controller 56 as disclosed herein is capable of and may be operable to perform any methods or associated method steps as disclosed herein. For example, in some embodiments, methods disclosed herein may be embodied in programming instructions stored in the memory and executed by the controller 56.

In various embodiments, the user interface panel 71 is positioned at the front panel 14. In particular embodiments, user interface panel 71 is positioned proximate to one of the pair of side panels and distal to another of the pair of side panels. In an embodiment, user interface panel 71 is positioned alongside second panel 20 and distal to first panel 18, e.g., distal along lateral direction L. Controller 56 is positioned proximate to one of the pair of side panels and distal to another of the pair of side panels. In such an embodiment, controller 56 is positioned alongside second panel 20 and distal to first panel 18, e.g., distal along lateral direction L.

Referring to FIGS. 3-11, embodiments of a system for steam generation (hereinafter, "system 100") including an induction heating element 120, a ferrous substrate 125, and a non-ferrous substrate 130 are provided. The non-ferrous substrate 130 is positioned between the induction heating element 120 and the ferrous substrate 125, such as to form a gap between the heating element 120 and the ferrous substrate 125 to allow an electrical current to form to heat the ferrous substrate 125. The induction heating element 120 and non-ferrous substrate 130 are positioned at or proximate to a first side 101, such as an external side, of a manifold 110. The system 100 includes a nozzle 140 for ejecting water to the ferrous substrate 125. The nozzle 140 is positioned at or proximate to a second side 102, such as an internal side, at the ferrous substrate 125 (i.e., distal to the first side 101).

In various embodiments, the system 100 includes manifold 110 at which the ferrous substrate 125 is formed. The nozzle 140 may be positioned at the manifold 110, such as to eject water to an interior volume formed at the manifold 110. The non-ferrous substrate 130 is positioned at an exterior surface, such as at the first side 101, of the manifold 110. The induction heating element 120 is positioned on the non-ferrous substrate 130, such as at the first side 101 or within the interior volume, such that the non-ferrous substrate 130 is positioned between the induction heating element 120 and the ferrous substrate 125. In some embodiments, the manifold 110 forms an outer shell formed of the ferrous substrate 125, or forms the outer shell of a non-ferrous material and including a ferrous substrate 125 at the second side 102 within the interior volume.

In some embodiments, the manifold 110 includes an outlet face 112 at which an opening 114 is formed. The interior volume of the manifold 110 may be formed between the outlet face 112 and the interior first side 101 at which the ferrous substrate 125 is formed. The nozzle 140 is configured to receive a water supply, such as to flow and spray liquid water to the ferrous substrate 125 at the interior volume. The outlet face 112 forms the openings 114 to allow steam to egress from the interior volume to the chamber 25. For instance, in various embodiments, the manifold 110 is positioned in fluid communication with the chamber 25. For instance, the manifold 110 may be attached directly to the rear panel 16 and include outlet opening 114 positioned to provide direct fluid communication to the chamber 25, such as to allow steam generated at the manifold 110 to propagate into the chamber 25. However, it should be appreciated that other embodiments of the dryer appliance 10 may include the manifold 110 attached to the cabinet 12, such as side panel 18, 20. Steam is provided through openings 39, such as positioned through rear wall 34, baffles 27, or a cylinder sidewall of drum 26.

In some embodiments, the manifold 110 includes an opening 116 configured to receive a flow of air or stream. For instance, the opening 116 may be configured to receive a flow of air such as to push the steam through the openings 114 into the chamber 25. In another instance, the opening 116 allows steam to flow into other parts of the system, such as to clean or sanitize other portions of the dryer appliance 10. In various embodiments, the manifold 110 may be positioned or formed as part of the duct 41 or air handler 42. For instance, motor 31 may operate to push or draw air through the air handler 42 and duct 41, such as described in regard to FIG. 2. Manifold 110 may be formed as an embodiment of duct 41, or a portion thereof. For instance, an exit of heating system 40 may connect to opening 116 at manifold 110 forming all or a portion of duct 41.

The induction heating element 120 is configured to generate a current at the ferrous substrate 125 at the manifold 110, such as to heat the ferrous substrate 125. The nozzle 140 is configured to eject liquid water to the ferrous substrate 125. Liquid water at the heated ferrous substrate 125 is phase changed to water vapor. The manifold 110 includes the exit opening 114 in fluid communication with the chamber 25, such as to allow water vapor to egress to the chamber 25.

In still various embodiments, positioning the non-ferrous substrate 130 and the ferrous substrate 125 between the nozzle 140 and the induction heating element 120 prevents water from contacting the induction heating element 120. The induction heating element 120 may avoid deterioration associated with direct contact with water, such as, but not limited to, build-up of solids or thermal cycling. Additionally, the induction heating element 120, rather than, e.g., a resistive heating element, does not become physically heated. Accordingly, the induction heating element 120 may be positioned at an external area of the dryer, while mitigating fire risks, such as by heating of unintended surfaces (e.g., surfaces other than those required for generating steam for the chamber).

In various embodiments, the non-ferrous substrate 130 is a film, a washer, a standoff, a porous surface, or other structure providing a gap between the induction heating element 120 and the ferrous substrate 125 or other non-contact of the induction heating element 120 and the ferrous substrate 125. In some embodiments, the non-ferrous substrate 130 is a super fine paper, such as a thermal paper or audit roll. The super fine paper, such as a thermal paper or audit roll, may unexpectedly and advantageously provide a suitable non-ferrous surface generating a close gap between the induction heating element 120 and the ferrous substrate 125. For instance, the thermal paper may provide an even, uniform thickness, thin film gap between the induction heating element 120 and the ferrous substrate 125 with appropriate porosity that promotes thermal generation at the ferrous substrate 125 by the induction heating element 120. In another instance, the super fine paper may promote a desired electrical charge for operation of the induction heating element 120 to generate heat at the ferrous substrate 125 rather than at the non-ferrous substrate 130, such as to desirably heat a first surface adjacent to the volume at which liquid water is provided to the manifold 110 and desirably not heat (e.g., keep cool) a second surface at which the non-ferrous substrate 130 is positioned.

In still other embodiments, the non-ferrous substrate 130 may include a glass, silicone, room temperature vulcanizing (RTV) silicone, PTFE-fiberglass cloth, or other non-ferrous material. The non-ferrous substrate 130 may include a washer, a standoff, a spacer, or other structure generating a gap and non-contact between the induction heating element 120 and the ferrous substrate 125.

Embodiments of the ferrous substrate 125 at the manifold 110 may include any appropriate conductive material configured to be heated by a process of electromagnetic induction via the induction heating element 120. In various embodiments, the induction heating element 120 forms a coil of any appropriate quantity of turns and bends positioned adjacent to the exterior surface of the manifold 110, such as at the first side 101. The induction heating element 120 includes an electromagnet and electronic oscillator configured to pass a high frequency alternating current through the electromagnet, such as to generate a rapidly alternating magnetic field that generates electric currents (e.g., eddy currents) at the ferrous substrate 125. One skilled in the art will appreciate that any appropriate frequency of electric current may be determined based on dimensions of the manifold (e.g., area, thickness, etc.), material, desired temperature, desired energy input, and gap between the induction heating element 120 and ferrous substrate 125. In various embodiments, the gap between the induction heating element 120 and the ferrous substrate 125 is between approximately 1.5 millimeters and approximately four (4) millimeters. In some embodiments, the gap between the induction heating element 120 and the and the ferrous substrate 125 is between approximately two (2) millimeters and approximately three (3) millimeters.

Embodiments of the dryer appliance 10 and system for steam generation 100 provided herein may advantageously avoid wet spots on cloths, provide sanitization of the clothes load or chamber 25, spread steam more uniformly on garments, such as to improve de-wrinkling or reduce drying cycle time. The induction heating element 120 may furthermore provide benefits over convection coil generated steam systems by providing faster (e.g., near-instantaneous) heating and reduced energy usage for producing heat. Embodiments of the dryer appliance 10 and system 100 may remove a need for a reservoir to hold water for generating steam, and may furthermore remove a potential vector for bacteria development and propagation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, the dryer appliance comprising:

a drum rotatably mounted within a cabinet, the drum defining a chamber for receipt of articles for drying, the drum comprising a plurality of openings allowing fluid communication into the chamber; and a steam generation system comprising an induction heating element positioned on a non-ferrous substrate comprising a super fine paper, the non-ferrous substrate positioned between the induction heating element and a ferrous substrate, wherein the ferrous substrate is positioned in an interior volume, and wherein a nozzle is positioned in the interior volume to eject water onto the ferrous substrate, and wherein the induction heating element is positioned fluidly separate from the water ejected from the nozzle.

2. The dryer appliance of claim 1, wherein the non-ferrous substrate comprising the super fine paper comprises a thermal paper or audit roll.

3. The dryer appliance of claim 1, wherein the non-ferrous substrate comprising the super fine paper is distributed as a uniform thickness thin film gap between the induction heating element and the ferrous substrate.

4. The dryer appliance of claim 1, wherein the non-ferrous substrate positioned between the induction heating element and the ferrous substrate forms a gap between the induction heating element and the ferrous substrate.

5. The dryer appliance of claim 4, wherein the gap between the induction heating element and the ferrous substrate is between approximately 1.5 millimeters and approximately 4 millimeters.

6. The dryer appliance of claim 4, wherein the gap between the induction heating element and the ferrous substrate is between approximately 2 millimeters and approximately 3 millimeters.

7. The dryer appliance of claim 1, wherein the non-ferrous substrate comprises a glass material, a silicone material, or a fiberglass cloth material.

8. The dryer appliance of claim 1, wherein the non-ferrous substrate comprises a washer, a spacer, or a standoff.

9. A steam generating dryer appliance, the steam generating dryer appliance comprising:

a drum rotatably mounted within a cabinet, the drum defining a chamber for receipt of articles for drying, the drum comprising a plurality of openings allowing fluid communication into the chamber;

an air handler configured to urge air into a heater assembly and provide air through a duct, the duct in fluid communication with the plurality of openings at the drum to allow air to flow into the chamber;

a manifold formed at the duct, the manifold comprising an outlet face at which an outlet opening is formed, wherein the outlet opening provides fluid communication from the heater assembly to the chamber, the manifold forming an interior volume at which a nozzle is positioned to eject liquid water, the manifold comprising a ferrous substrate at an internal side of the manifold at which the nozzle is configured to eject liquid water onto;

a non-ferrous substrate positioned at an external side of the manifold, the non-ferrous substrate comprising a super fine paper; and an induction heating element positioned on the non-ferrous substrate, the non-ferrous substrate positioned between the induction heating element and the ferrous substrate at the manifold.

10. The steam generating dryer appliance of claim 9, wherein the non-ferrous substrate comprising the super fine paper comprises a thermal paper or audit roll.

11. The steam generating dryer appliance of claim 9, wherein the non-ferrous substrate comprising the super fine paper is distributed along the external side of the manifold as a uniform thickness thin film gap between the induction heating element and the ferrous substrate.

12. The steam generating dryer appliance of claim 9, wherein the non-ferrous substrate positioned between the induction heating element and the ferrous substrate forms a gap between the induction heating element and the ferrous substrate.

13. The steam generating dryer appliance of claim 12, wherein the gap between the induction heating element and the ferrous substrate is between approximately 1.5 millimeters and approximately 4 millimeters.

14. The steam generating dryer appliance of claim 12, wherein the gap between the induction heating element and the ferrous substrate is between approximately 2 millimeters and approximately 3 millimeters.

15. The steam generating dryer appliance of claim 14, wherein the induction heating element is positioned at an exterior surface of the dryer appliance.

16. The steam generating dryer appliance of claim 9, wherein the cabinet comprises a rear panel, and wherein the manifold is positioned at the rear panel.

17. The steam generating dryer appliance of claim 9, wherein the non-ferrous substrate comprises a glass material, a silicone material, or a fiberglass cloth material.

18. The steam generating dryer appliance of claim 9, wherein the non-ferrous substrate comprises a washer, a spacer, or a standoff.

* * * * *